US007676952B2

(12) United States Patent
Nakagawa et al.

(10) Patent No.: US 7,676,952 B2
(45) Date of Patent: Mar. 16, 2010

(54) HAIR DRYER WITH STATIC ATOMIZING DEVICE

(75) Inventors: Takashi Nakagawa, Kyoto (JP); Yasunori Matsui, Hikone (JP); Naofumi Kodama, Nagahama (JP); Tomohiro Yamaguchi, Yasu (JP); Kiyoshi Takashima, Hikone (JP); Toshihisa Hirai, Hikone (JP); Kishiko Hirai, legal representative, Hikone (JP); Kenji Kamada, Hikone (JP); Kengo Ito, Hikone (JP); Kazumi Okawa, Hikone (JP); Atsushi Isaka, Hikone (JP); Shinya Murase, Hikone (JP)

(73) Assignee: Matsushita Electric Works, Ltd., Kadoma (JP)

( * ) Notice: Subject to any disclaimer, the term of this patent is extended or adjusted under 35 U.S.C. 154(b) by 707 days.

(21) Appl. No.: 11/338,894

(22) Filed: Jan. 25, 2006

(65) Prior Publication Data

US 2006/0201016 A1 Sep. 14, 2006

(30) Foreign Application Priority Data

Jan. 28, 2005 (JP) ..... 2005-021418
Jun. 1, 2005 (JP) ..... 2005-161983

(51) Int. Cl.
*A45D 20/00* (2006.01)

(52) U.S. Cl. ..... 34/97; 34/253; 239/690; 239/706

(58) Field of Classification Search ..... 239/700, 239/704, 705, 706, 707, 690, 690.1, 416.5; 34/96, 97, 98, 250, 253, 254
See application file for complete search history.

(56) References Cited

U.S. PATENT DOCUMENTS

| | | | | |
|---|---|---|---|---|
| 3,985,297 | A * | 10/1976 | Itoh | 239/698 |
| 4,331,298 | A * | 5/1982 | Bentley et al. | 239/690 |
| 5,080,289 | A * | 1/1992 | Lunzer | 239/690 |
| 5,115,971 | A * | 5/1992 | Greenspan et al. | 239/3 |
| 6,910,281 | B2 * | 6/2005 | Ito | 34/96 |
| 6,941,675 | B2 * | 9/2005 | Slingo | 34/96 |
| 2003/0033726 | A1 | 2/2003 | Saida | |

(Continued)

FOREIGN PATENT DOCUMENTS

EP 1 285 599 A2 2/2003

(Continued)

OTHER PUBLICATIONS

European Search Report Jun. 1, 2006.

(Continued)

*Primary Examiner*—Kenneth B Rinehart
(74) *Attorney, Agent, or Firm*—Edwards Angell Palmer & Dodge LLP

(57) ABSTRACT

A hair dryer having a static atomizing device, which has the capability of generating an electrostatically charged microparticle mist of 3 nm to 100 nm. The static atomizing device has a pair of an atomizing electrode and a counter electrode, a tank for storing a liquid such as water; a liquid transport member for transport water from the tank to the atomizing electrode according to capillary phenomenon, and a voltage applying unit. When a high voltage is applied between the atomizing electrode and the counter electrode, while water being supplied to the atomizing electrode through the liquid transport member, the electrostatically charged microparticle mist is generated.

8 Claims, 5 Drawing Sheets

U.S. PATENT DOCUMENTS

| | | | |
|---|---|---|---|
| 2004/0020070 | A1 | 2/2004 | Ito |

FOREIGN PATENT DOCUMENTS

| | | | |
|---|---|---|---|
| EP | 1 639 910 | A2 | 3/2006 |
| JP | 54-065745 | | 5/1979 |
| JP | 3026194 | | 4/1996 |
| JP | 2000-176325 | | 6/2000 |
| JP | 2002-191426 | | 7/2002 |
| JP | 2003-59622 | | 2/2003 |
| JP | 2004-008988 | | 1/2004 |
| JP | 2005-103501 | | 4/2005 |
| WO | WO 2005/102101 | A1 | 11/2005 |

OTHER PUBLICATIONS

Japanese Examination Report w/ English Language Translation, for Japanese Application No. 2005-021418, dated Jul. 10, 2007.

Japanese Office Action dated May 12, 2009, issued in JP2005-161983.

* cited by examiner

HAIR DRYER WITH STATIC ATOMIZING DEVICE

BACKGROUND OF THE INVENTION

1. Field of the Invention

The present invention relates to a hair dryer, and particularly the hair dryer with a static atomizing device for generating an electrostatically charged microparticle mist of a liquid such as water.

2. Description of the Related Art

In the past, a hair dryer with a negative-ion generator has been widely utilized for hair drying, hair styling, and a hair treatment. For example, Japanese Patent Early Publication No. 2002-191426 discloses a hair dryer for providing an airflow containing negative ions. According to this hair dryer, it is possible to effectively prevent that negative ions are trapped by a grid member attached to an air outlet, and achieve a stable supply of the minus ions.

By the way, very fine water particles of about 1 nm derived from the moisture in the air are adhered to the negative ions generated by the negative-ion generator of the above hair dryer. However, the very fine water particles are easily vaporized when contacting a hot air supplied from the air outlet. Thus, the conventional hair dryer still has plenty of room for improvement from the viewpoint of stably supplying a sufficient amount of moisture to the user's hair.

SUMMARY OF THE INVENTION

Therefore, a primary concern of the present invention is to provide a hair dryer with a static atomizing device, which has the capability of stably supplying an electrostatically charged microparticle mist of a liquid such as water preferably having a particle size of 3 nm to 100 nm.

That is, the hair dryer of the present invention is mainly composed of a housing formed in a substantially hollow structure, which has an air inlet, air outlet, and an airflow channel extending therebetween; a fan configured to suck an outside air into the housing through the air inlet to provide an air flow through the air outlet; and the static atomizing device configured to electrostatically atomize the liquid to generate the electrostatically charged microparticle mist of the liquid. In particular, it is preferred that the static atomizing device is provided with at least one pair of an atomizing electrode and a counter electrode, a tank configured to store the liquid therein; a liquid transport member configured to transport the liquid from the tank to the atomizing electrode, and a voltage applying unit configured to apply a voltage between the atomizing electrode and the counter electrode to generate the electrostatically charged microparticle mist.

According to the present invention, a sufficient amount of the electrostatically charged microparticle mist having a particle size of 3 nm to 100 nm can be stably supplied to the user's hair. Therefore, it is possible to more efficiently obtain moist hair that is suitable to perform hairstyling or a hair treatment than before.

In the above hair dryer, it is preferred that the tank is disposed at a higher position than the atomizing electrode in a standing posture of the hair dryer. In this case, it is possible to stably transport the liquid from the tank to the atomizing electrode by using a liquid head pressure of the liquid stored in the tank.

In addition, it is preferred that the liquid transport member is made of a flexible material, and connected at its one end to the tank and at its opposite end to the atomizing electrode, thereby transporting the liquid from the tank to the static atomizing electrode according to capillary phenomenon. By use of the flexible liquid transport member, it is possible to improve a degree of freedom of layout of the tank in the hair dryer. In addition, because the liquid transport member uses the capillary phenomenon to transport the liquid, it is possible to more efficiently and stably transport the liquid to the atomizing electrode by help of the liquid head pressure described above.

It is also preferred that the atomizing electrode has an opening at its one end, which is configured to supply the liquid into a space between the atomizing electrode and the counter electrode, and a size of the opening is determined such that a surface tension of the liquid (e.g., water) at the opening is larger than a liquid head pressure (e.g., water head pressure) applied to the opening by the liquid in the tank full-filled. In this case, the liquid needed to generate the electrostatically charged microparticle mist is exposed to the discharge space through the opening, and undesired leakage of the liquid from the atomizing electrode can be reliably prevented.

In addition, it is preferred that the housing comprises a pair of mist generation chambers formed at both lateral sides of the airflow channel, in each of which the atomizing electrode and the counter electrode are disposed, and a tank chamber formed at an upper side of the airflow channel to detachably accommodate the tank, which is commonly used to supply the liquid into the mist generation chambers. In this case, because the liquid is supplied from the single tank to the respective atomizing electrodes through the liquid transport members, it is possible to downsize the static atomizing device. In addition, as compared with a case that a plurality of tanks are disposed in the hair dryer such that each of the tanks is connected to one of the atomizing electrodes by a corresponding liquid transport member, there is an another advantage in that an operation of replenishing the liquid in the tank becomes easier.

In the above hair dryer, it is preferred that the housing has a mist outlet formed in a different position from the air outlet, and a mist generation room for accommodating the atomizing electrode and the counter electrode therein, which is communicated to the mist outlet. Furthermore, it is preferred that the housing has a mist flow channel communicated to the airflow channel such that a part of the air flow in the airflow channel is mixed with the electrostatically charged microparticle mist generated in the mist generation room, and then a resultant mixture is provided from the mist outlet. In this case, because the electrostatically charged microparticle mist can be stably ejected from the mist outlet by help of the air flow provided from the airflow channel.

As another preferred embodiment of the static atomizing device according to the present invention, the static atomizing device is provided with a plurality of atomizing electrodes connected in parallel to a voltage applying unit and counter electrodes; a single tank configured to store the liquid therein; liquid transport members each configured to transport the liquid from the single tank to one of the atomizing electrodes, the voltage applying unit configured to apply a voltage between the atomizing electrodes and the counter electrodes to generate electrostatically charged microparticle mist of the liquid, and resistive elements connected between the voltage applying unit and the atomizing electrodes. In this case, by approximately determining a resistance value of each of the resistive elements, it is possible to control an influence of distances between the atomizing electrodes and the counter electrodes on discharge states therebetween, and stably generate a larger amount of the electrostatically charged microparticle mist. In addition, there are another advantages of reducing a generation amount of ozone and prevent the occurrence of abnormal discharge.

These and additional features of the present invention and advantages brought thereby will become more apparent from the following detail description of the invention.

DETAILED DESCRIPTION OF EXEMPLARY EMBODIMENTS

A hair dryer with a static atomizing device of the present invention is explained in details according to exemplary embodiments, referring to the attached drawings.

Figure 1:
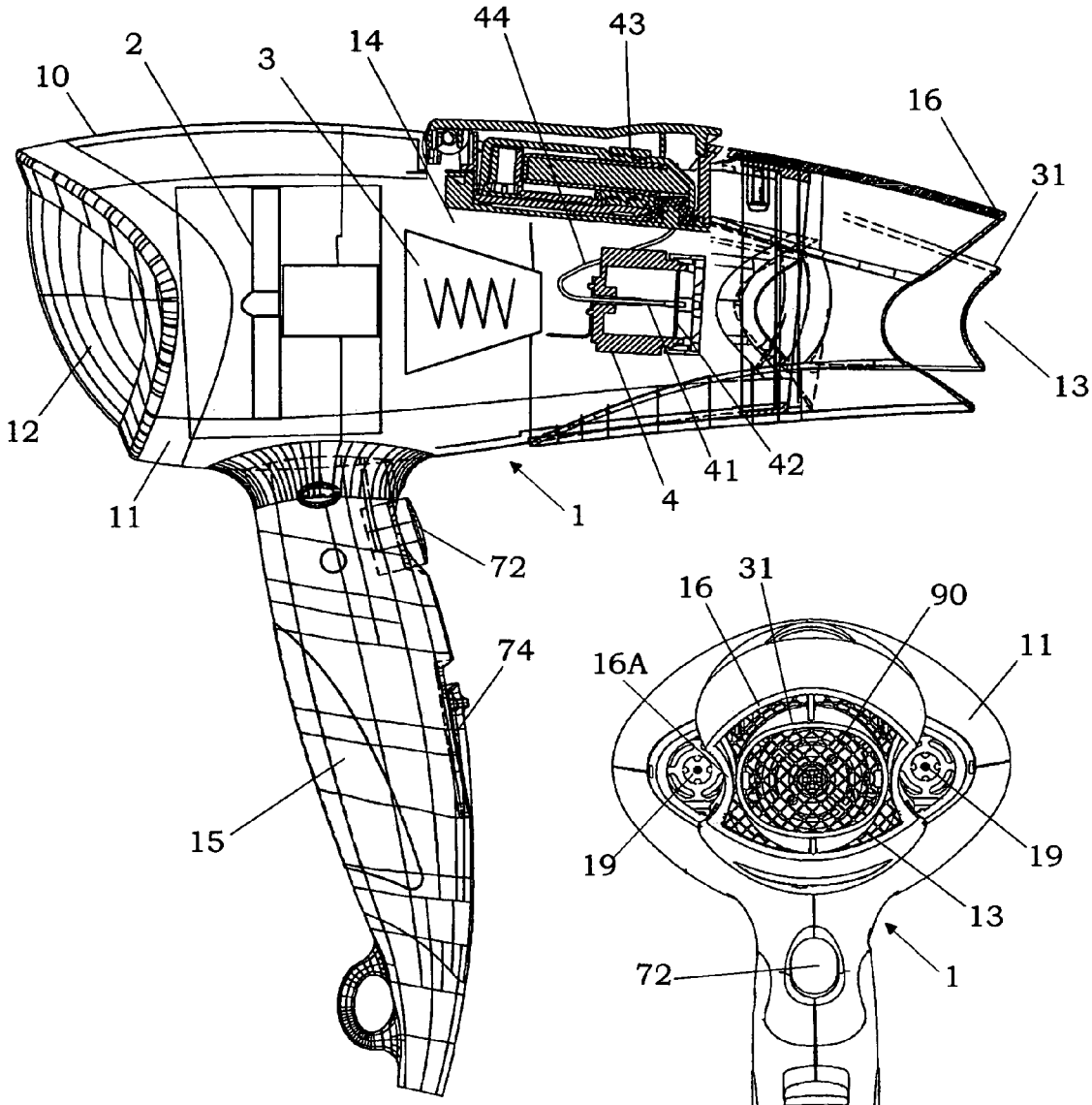
FIG. 1 is a schematic diagram of a hair dryer according to a preferred embodiment of the present invention.
Figure 2:
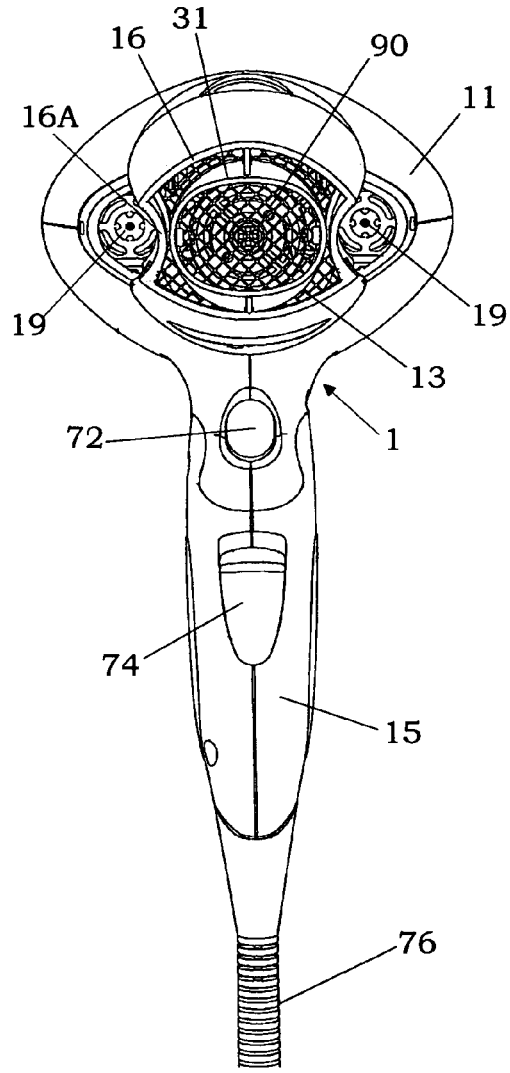
FIG. 2 is a front view of the hair dryer of this embodiment.
Figure 3:
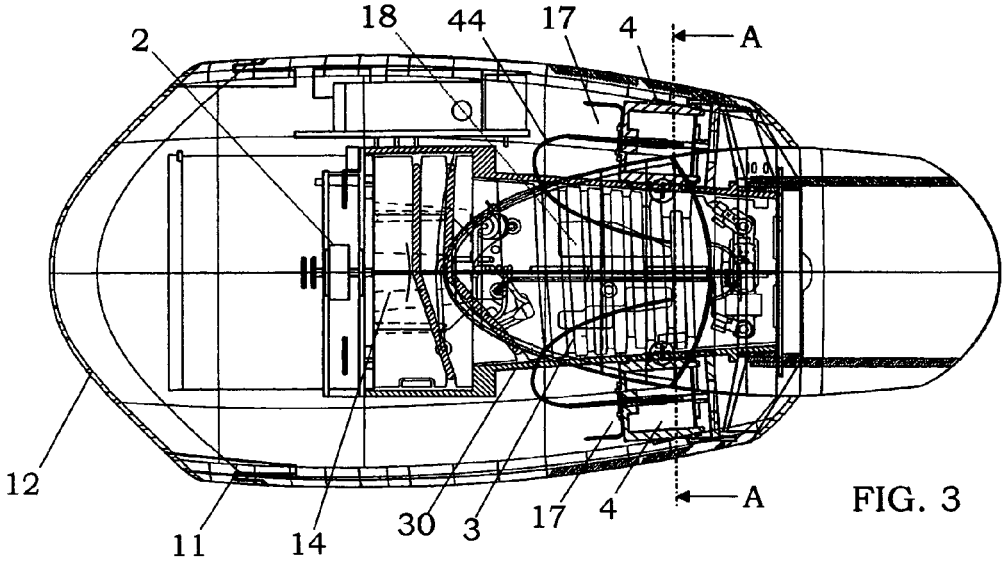
FIG. 3 is a partially-enlarged top view with cross sections of relevant portions of the hair dryer.

As shown in FIGS. 1 to 3, the hair dryer 1 of this embodiment has a housing 10 for accommodating a fan 2, a heater 3 and a static atomizing device 4 therein. The housing 10 is mainly composed of a main housing 11 formed in a substantially hollow structure and having an air inlet 12 at its one end, an air outlet 13 at its opposite end, and an airflow channel 14 extending therebetween, and a grip housing 15 extending downward from the main housing 11. In the drawings, the numeral 72 designates a push button formed on the grip housing 15 to switch the fan 2 between ON and OFF states, and switch the hater 3 between ON and OFF states when the fan 2 is in the ON state. The numeral 74 designates a slide button formed on the grip housing 15 to control the airflow amount provided by the fan 2 in a stepwise manner. The numeral 90 designates a grid member attached to air inlet 12 and the air outlet 13 to prevent foreign matter from getting into the main housing 11. The numeral 76 designates a power code for supplying electric power to the hair dryer 1.

The fan 2 is disposed at the vicinity of the air inlet 12 in the main housing 11. The heater 3 is disposed in a tubular member 30 placed at a downstream side of the fan 2 in the airflow channel 14 in the main housing 11. The air supplied into the tubular member 30 by the fan 2 is heated by the heater 3, so that the heated air is ejected as a hot airflow from a substantially center region of the air outlet 13. On the other hand, the air supplied into a clearance between the tubular member 30 and an inner surface of the main housing 11 by the fan 2 is ejected as a cold airflow from a periphery of the substantially center region of the air outlet. In this embodiment, the tubular member 30 is formed such that a forward end of the tubular member projects outside from the air outlet 13 to provide an inner nozzle 31. Therefore, the hot airflow is focused by the inner nozzle 31, and the cold airflow is focused by an outer nozzle 16 extending along the outline of the air outlet 13. Thus, the hair dryer of the present invention can provide a double-layered airflow comprised of an inner layer of the hot airflow and an outer layer of the cold airflow from the air outlet 13. If necessary, an additional tubular member (not shown) may be disposed between the tubular member 30 and the inner surface of the main housing 11 to control the cold airflow.

Figure 4:
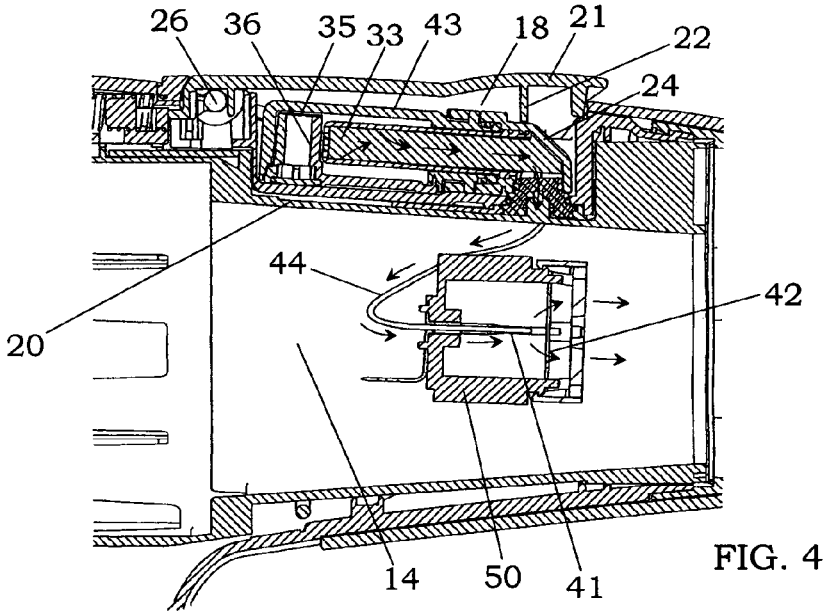
FIG. 4 is a cross-sectional view of a static atomizing device of the hair dryer.

As shown in FIGS. 3 and 4, the static atomizing device 4 of this embodiment is formed with two pairs of an atomizing electrode 41 and a counter electrode 42, a single tank 43 configured to store a liquid such as water therein; liquid transport members 44 each configured to transport the liquid from the tank 43 to the corresponding atomizing electrode 41, and a voltage applying unit (e.g., 60 in FIG. 9) configured to apply a high voltage between the atomizing electrodes 41 and the counter electrodes 42 to generate an electrostatically charged microparticle mist of the liquid. The main housing 11 also has a pair of mist generation rooms 17 formed at both lateral sides of the airflow channel 14, in each of which the atomizing electrode 41 and the counter electrode 42 are disposed, a tank chamber 18 formed at an upper side of the airflow channel 14 to detachably accommodate the tank 43 therein, and mist outlets 19 formed in different positions from the air outlet 13, each of which is communicated to the mist generation room 17. In the main housing 11, each of the mist generation rooms 17 is communicated to the airflow channel 14 though a mist flow channel, so that a part of the air flow in the airflow channel 14 is mixed with the electrostatically charged microparticle mist generated in the mist generation room 17, and then a cold airflow containing the electrostatically charged microparticle mist is provided from the mist outlet 19.

In this embodiment, as shown in FIG. 2, the outer nozzle 16 of the air outlet 13 is designed in a unique shape to have concave portions 16A arcuately extending at its left and right sides. In addition, the mist outlets 19 are positioned adjacent to the concave portions 16A. By using this layout of the mist outlets 19 and the shape of the outer nozzle 16, the cold airflow containing the electrostatically charged microparticle mist provided from the mist outlets 19 can be easily joined with the airflow provided from the air outlet 13. Consequently, it is possible to more efficiently spray the electrostatically charged microparticle mist to the user's hair.

In the hair dryer 1 described above, when both of the fan 2 and the heater 3 are in the ON state, the hot air is provided from the inner nozzle 31, only the cold air is provided from the clearance between the outer nozzle 16 and the inner nozzle 31, and simultaneously the cold air containing the electrostatically charged microparticle mist can be provided from the mist outlets 19. On the other hand, when the fan 2 is in the ON state, and the heater 3 is in the OFF state, only the cold air is provided from the inner nozzle 31 and the outer nozzle 16, and simultaneously the cold air containing the electrostatically charged microparticle mist can be provided from the mist outlets 19. In addition, as described later, when the airflow amount provided by the fan 2 is changed by operating the slide switch 74, a generation amount of the electrostatically charged microparticle mist may be controlled in response to the airflow amount changed.

Figure 5:
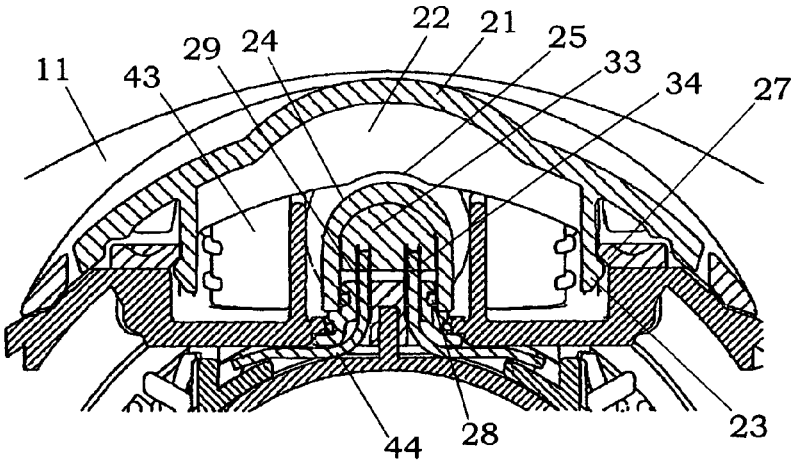
FIG. 5 is a partially cross-sectional view taken along the line A-A of FIG. 3.

The static atomizing device 4 used in the hair dryer 1 of this embodiment is explained in more detail. As described above, the tank 43 is detachably mounted in the tank chamber 18, which is formed in a top surface of the main housing 11, and separated from the airflow channel 14 by a partition wall 20. The main housing 11 also has a tank cover 21, which is pivotally supported about a horizontal axis 26 at its rear end by the main housing 11. In addition, as shown in FIG. 5, the tank cover 21 has a rib 22 projecting downward from its inside surface, which is configured to press the tank 43 against the partition wall 20 when the tank cover 21 is closed. Therefore, the tank 43 can be stably held in the tank chamber 18 without shaking. The tank 43 also has a cap 24 at its forward top end, which can be opened to supply the liquid into the tank 43. In FIG. 5, the numeral 25 designates a recess arcuately extending at a substantially center region of the bottom end of the rib 22, which is fitted to an arcuate top portion of the cap 24 when the tank cover 21 is closed. The numeral 23 designates a pair of hooks projecting downward from the tank cover 21, which can be engaged to engaging portions 27 formed in the tank chamber 18 to provide a closed state of the tank cover. Therefore, it is possible to prevent falling of the tank 43 from the tank chamber 18 through the tank cover 21 accidentally opened.

In the hair dryer 1 of the present invention, as shown in FIG. 4, the tank 43 may be disposed at a higher position than the atomizing electrode 41 in a standing posture of the hair dryer shown in FIG. 2. Thereby, a sufficient amount of the liquid can be transported from the tank 43 to the atomizing electrodes 41 by use of the capillary phenomenon of the liquid transport members 44 and the liquid head pressure of the liquid stored in the tank. The tank 43 has a liquid outlet 29 formed in the bottom surface at its forward end, into which one end of each of the liquid transport members 44 is inserted. In FIG. 5, the numeral 28 designate an O-ring, which presents a water-tight sealing between the cap 24 and the tank 43. The numeral 33 designates an ion exchanger such as an ion exchange fiber accommodated in the tank 43. Therefore, the liquid in the tank 43 is purified by the ion exchange fiber 33, and then supplied to the liquid transport member 44.

In this embodiment, as the ion exchanging fiber 33, both of an anion exchange fiber containing quaternary amine and a cation exchange fiber are accommodated in the tank 43. In addition, the ion exchange fiber 33 is supported on a base material such as felt to obtain a water-absorbing property. The anion exchange fiber removes anions from the liquid to prevent the precipitation of impurity at the atomizing electrodes 41. The quaternary amine in the anion exchange fiber exhibits an antibacterial effect to prevent the propagation of bacteria in the tank 43. On the other hand, the cation exchange fiber removes cations from the liquid to prevent the precipitation of calcium and magnesium included in tap water at the atomizing electrodes 41. One of the anion and cation exchange fibers may be provided in the tank 43.

The one end of each of the liquid transport members 44 is inserted into the ion exchanger 33 accommodated in the tank 43 through the liquid outlet 29 in a substantially vertical direction, as shown in FIG. 5. In this case, even when the hair dryer 1 is used in an inclined posture, the liquid in the tank 43 can stably contact the liquid transport members 44 through the ion exchange fiber 33. Therefore, it is possible to reliably supply the liquid from the tank 43 to the liquid transport members 44. In addition, the one end of the respective liquid transport member 44 is inserted in a protection tube 34 made of a metal material such as stainless steel. The protection tube 34 prevents the liquid transport members 44 from breakage and contamination. In particular, the top end of the liquid transport member 44 inserted in the protection tube 34 may be spaced downward from a top end of the protection tube 34 by a vertical distance of not larger than 0.5 mm. In this embodiment, the vertical distance is 0.2 mm. In this case, it is possible to reliably achieve both of the stable supply of the liquid to the liquid transport members 44 and the effect of preventing the liquid transport members from breakage and contamination.

Figure 6:
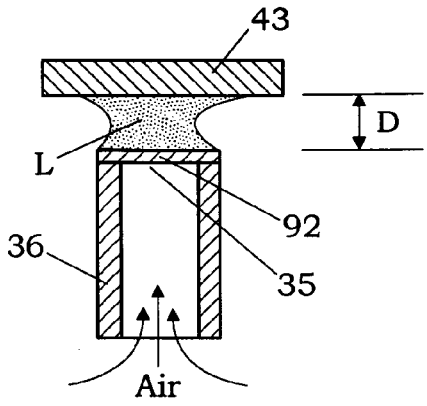
FIG. 6 is a diagram showing a liquid held between an inner surface of a tank and a membrane member by surface tension.

The tank 43 has an air intake 35 at its rear end. That is, as shown in FIG. 4, the air intake 35 is provided by a top opening of a cylindrical wall 36 vertically projecting from the bottom surface of the tank. In addition, as shown in FIG. 6, the air intake 35 is covered by a membrane member 92 having permeability to air and non-permeability to the liquid such as water. In this case, it is preferred that a clearance D between the membrane member 92 attached to the air intake 35 and an upper inner surface (i.e., ceiling wall) of the tank 43 is not larger than 1 mm. In this embodiment, the clearance D is 0.6 mm. As described below, this membrane member 92 works as a film for regulating the inner pressure of the tank 43.

When the liquid L does not exist between the membrane member 92 and the ceiling wall of the tank 43, the outside air flows in the tank through the membrane member, as shown by the arrows in FIG. 6, so that the inner pressure of the tank becomes equal to the atmospheric pressure. At this time, the liquid easily flows out through the liquid transport members 44 by help of the capillary phenomenon and the atmospheric pressure applied to the liquid surface in the tank. On the other hand, when the tank 43 is full-filled with the liquid, the liquid existing between the membrane member 92 and the ceiling wall of the tank 43 closes the air intake 35, as shown in FIG. 6, and prevents that the outside air comes in the tank through the membrane member 92. At this time, the liquid transport member 44 receives a liquid head pressure of the liquid stored in the tank. However, because the interior of the tank 43 is substantially placed in a sealed state by the presence of the liquid on the membrane member, the liquid slowly flows out through the liquid transport members 44 by help of the capillary phenomenon. When the clearance D is not larger than 1 mm, the liquid can be stably kept between the membrane member 92 and the ceiling wall of the tank 43 by the surface tension of the liquid even when the storage amount of the liquid in the tank decreases. Therefore, the sealed state of the tank 43 can be maintained for an extended time period. This is useful to prevent an excessive supply of the liquid from the tank 43 to the atomizing electrodes 41.

The liquid transport member 44 is made of a flexible material, and has the capability of transporting the liquid from the tank 43 to the atomizing electrode 41 by the capillary phenomenon. As described above, the one end of the liquid transport member 44 is inserted in the tank 43 through the liquid outlet 29, and the opposite end thereof is inserted in the atomizing electrode 41 having a tubular structure described later. For example, as the liquid transport member 44, a flexible tube member or a flexible string member made of a porous material can be used. By use of this flexible liquid transport member 44, it is possible to increase a degree of freedom of layout of the tank 43 in the hair dryer.

Figure 7A:
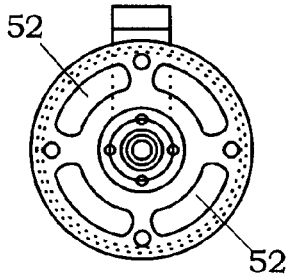
FIGS. 7A to 7C are front, cross-sectional and rear views, respectively, of a case for atomizing and counter electrodes of the static atomizing device.
Figure 7B:
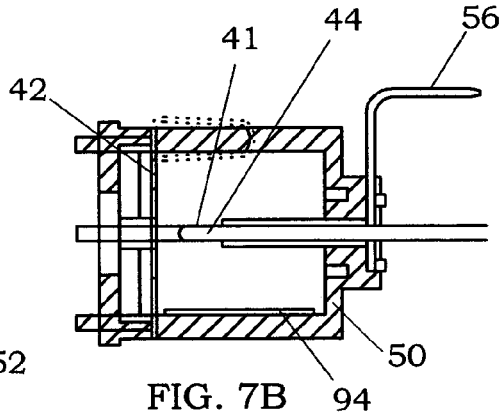
Figure 7C:
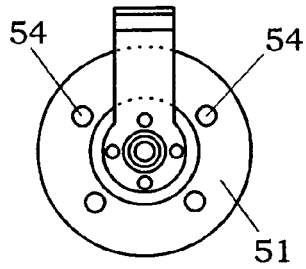
Figure 9:
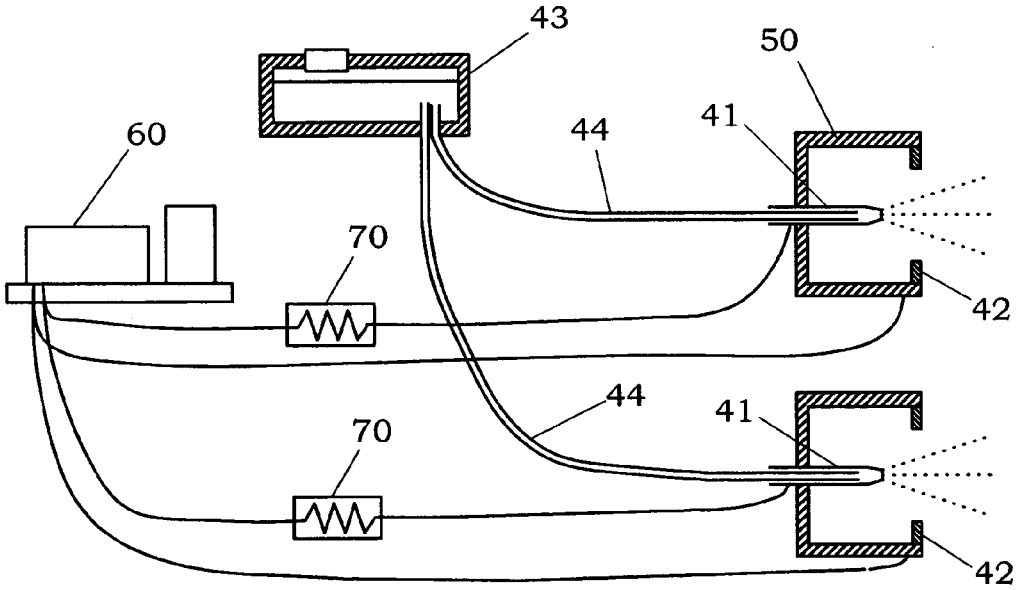
FIG. 9 is a schematic circuit diagram of a high voltage applying unit.

As shown in FIGS. 7A to 7C, the atomizing electrode 41 and the counter electrode 42 are supported in a case 50, which is of a cylindrical structure having a base 51 at its one end and openings 52 at the opposite end. That is, the atomizing electrode 41 has the tubular structure extending in the axial direction of the case 50, and the counter electrode 42 is configured in a ring shape and disposed to face the atomizing electrode 41. The electrostatically charged microparticle mist generated in a discharge space between the atomizing electrode 41 and the counter electrode 42 is ejected outside from the inside space of the ring shape of the counter electrode 42. The case 50 has air vent holes 54 formed in the base 51, through which a part of the airflow provided by the fan 2 comes in the case 50, and then mixed with the electrostatically charged microparticle mist generated in the discharge space, so that the airflow containing the electrostatically charged microparticle mist is ejected from the openings 52 of the case 50. In the drawings, the numeral 56 designates a terminal member used to electrically connect the atomizing electrode 41 with the voltage applying unit 60, as shown in FIG. 9. Moreover, it is preferred that a grid-like cover (not shown) for preventing electric shock is disposed at the openings 52 of the case 50. By using the grid-like cover made of an antistatic material such as silicon-based, organic boron-based and high polymer resin materials, it is possible to prevent the grid-like cover from being charged by the electrostatically charged microparticle mist.

In addition, a water absorbing material 94 may be disposed in the case 50. For example, a thickness of the water absorbing material 94 is 1 mm. In this case, even when a leakage of the liquid from the atomizing electrode 41 accidentally occurs, it can be caught by the water absorbing material 94. In addition, the water absorbing material 94 may by disposed such that a distance between the water absorbing material 94 and the atomizing electrode 41 is larger than the distance between the atomizing electrode 41 and the counter electrode 42 to prevent the occurrence of undesired discharge between the water absorbing material 94 and the atomizing electrode 41.

Figure 8A:
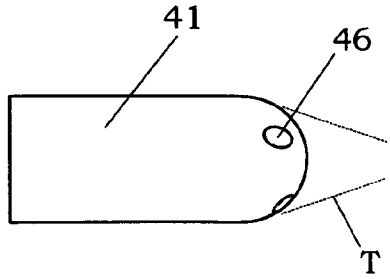
FIGS. 8A and 8B are side and end views of the atomizing electrode.
Figure 8B:
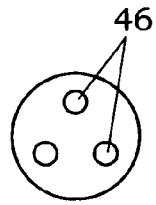

As shown in FIGS. 8A and 8B, the atomizing electrode 41 having the tubular structure, into which the liquid transport member 44 is inserted, has an arcuate end portion with openings 46 such as circular holes, which are configured to expose the liquid to the discharge space between the atomizing electrode 41 and the counter electrode 42. The atomizing electrode 41 may be made of a metal material having corrosion resistance such as stainless steel. To expose the liquid to the discharge space to stably generate the electrostatically charged microparticle mist of the liquid, while preventing the leakage of the liquid from the atomizing electrode 41, it is preferred that a size of the opening 46, i.e., a diameter of the circular hole is determined such that the surface tension of the liquid (e.g., water) at the circular hole is larger than the liquid head pressure (e.g., water head pressure) applied to the circular hole by the liquid in the tank 43 full-filled. Specifically, when the liquid is water, it is preferred that the diameter of the circular hole is not larger than 0.5 mm, and a vertical height of the tank 43 relative to the atomizing electrode 41 is not larger than 60 mm (more preferably not larger than 55 mm).

For example, when the diameter of the circular hole 46 is 0.5 mm, the surface tension $\Delta P$ is determined by calculating "2T/R", wherein "T" is a physical value of the liquid (when the liquid is water, "T" is $72.8\times10^{-3}$), and "R" is a radius of the circular hole (in this case, R is 0.25 mm). In this case, the surface tension $\Delta P$ is about 582 Pa. On the other hand, when the maximum vertical height of the tank 43 relative to the atomizing electrode 41 is 60 mm, the water head pressure is about 547 Pa. Thus, because the surface tension $\Delta P$ of water at the circular hole is larger than the maximum water head pressure, the leakage of the liquid from the atomizing electrode 41 is hard to happen. In this embodiment, the diameter of the circular hole 46 is 0.1 mm.

In this embodiment, the tank 43 is commonly used to generate the electrostatically charged microparticle mist at the both of the left and right mist generation rooms 17 by use of the flexible liquid transport members 44. Therefore, there are advantages of saving the space needed for the static atomizing device in the hair dryer, and comfortably performing an operation of replenishing the liquid in the tank. If necessary, a plurality of tanks may be disposed in the hair dryer. In addition, the tank 43 may be sharable among three or more of the mist generation rooms.

In this embodiment, the voltage applying unit 60 applies a high voltage between the atomizing electrode 41 and the counter electrode 42 in response to the switch operation of activating the fan 2. As an example, the voltage applying unit 60 of FIG. 9 has a high voltage generation circuit for generating a negative voltage of several kV, and applies the generated high voltage to the respective atomizing electrodes 41. The counter electrodes 42 are at ground potential. Alternatively, a voltage sufficiently smaller than the voltage applied to the atomizing electrode may be applied to the counter electrode 42. In FIG. 9, the numeral 70 designates a resistive element connected between each of the atomizing electrodes 41 and the voltage applying unit 60.

As described above, when a high voltage is applied between the atomizing electrode 41 and the counter electrode 42 by the voltage applying unit 60, the atomizing electrode becomes a negative electrode, so that electric charges are collected in the vicinity of the top end of the atomizing electrode 41. On the other hand, the liquid transported from the tank 43 by the capillary phenomenon of the liquid transport member 44 is exposed to the discharge space between the atomizing electrode 41 and the counter electrode 42 through the openings 46 of the atomizing electrode 41. Under these conditions, a Taylor cone T occurs at the top end of the atomizing electrode 41, as shown in FIG. 8A. In the Taylor cone T, the liquid is exposed to the high electric field, so that Rayleigh fission repeatedly happens to generate the electrostatically charged microparticle mist of the liquid such as water having a particle size of 3 nm to 100 nm. The generated mist is ejected from the mist outlet 19 of the hair dryer, and used to for hair drying, hairstyling, hair treatment and so on.

Figure 10A:
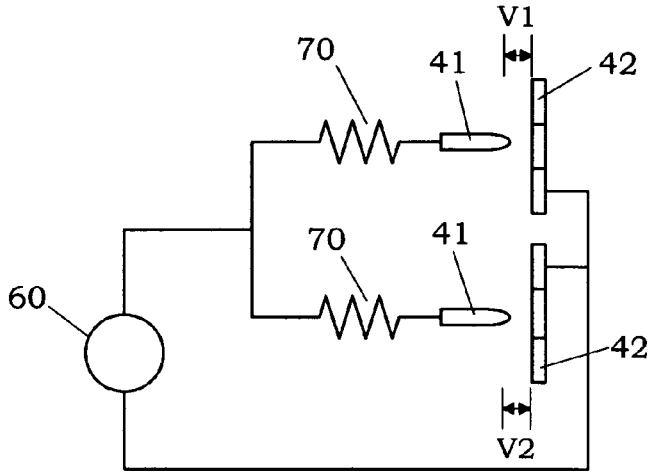
FIG. 10A is a schematic circuit diagram of the high voltage applying unit.
Figure 10B:
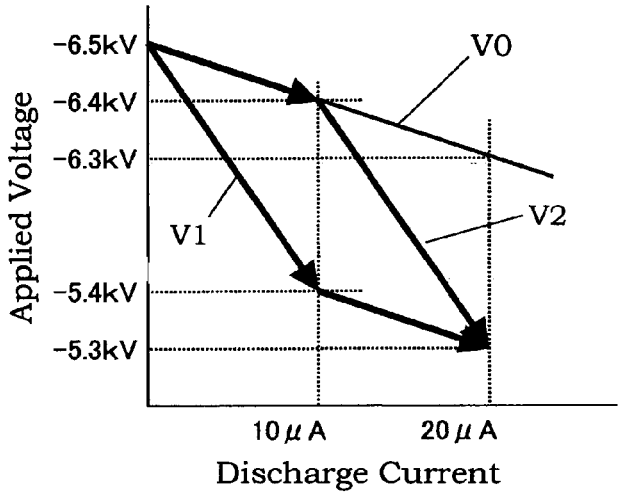
FIG. 10B is a graph showing a relation between discharge current and applied voltage.

By the way, as shown in FIG. 10A, when a plurality of atomizing electrodes 41 are connected in parallel to the voltage applying unit 60, it is preferred to insert the resistive element 70 therebetween. Each of the resistive elements 70 has a high resistance value of more than several MΩ, for example, 10 to 600 MΩ. By the presence of the resistive elements 70, a voltage drop happens, so that the voltages (V1, V2) between the atomizing electrodes 41 and the counter electrodes 42 can be regulated to stabilize the discharge states therebetween, as shown in FIG. 10B. In FIG. 10B, the resistance value of each of the resistive elements 70 is 100 MΩ, and "V0" designates the voltage generated by the voltage applying unit 60. In addition, there is a further advantage of reducing the concentration of ozone generated as a by-product. Moreover, by using the atomizing electrode 41 having a smoothly curved convex top, it is possible to further increase the effects brought by using the resistive elements 70, e.g., preventing the occurrence of abnormal discharge.

Figure 11:
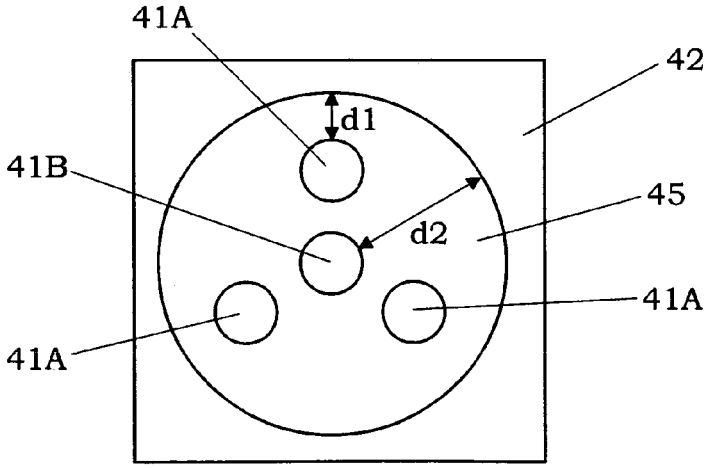
FIG. 11 is a plan view showing of an arrangement of atomizing electrodes and a common counter electrode.

In addition, as shown in FIG. 11, when four atomizing electrodes (41A, 41B) are disposed to face a common counter electrode 42 having a circular opening 45 such that, in a plan view of the electrode arrangement, three atomizing electrodes 41A are disposed on a circle that is a concentric circle of the circular opening 45, and the remaining atomizing electrode 41B is positioned at a center of the circular opening 45, a distance d2 between the atomizing electrode 41B and the counter electrode 42 is larger than the distance d1 between each of the atomizing electrodes 41A and the counter electrode 42. In such case, it is preferred that the resistive element 70 connected between the atomizing electrode 41B and the voltage applying unit 60 has a smaller resistance value than the resistive elements 70 connected between the atomizing electrodes 41A and the voltage applying unit 60 to uniformly atomizing the liquid. In addition, the use of the common counter electrode 42 that is sharable among the atomizing electrodes (41A, 41B) is particularly effective to downsize the static atomizing device 4 mounted in the hair dryer.

Figure 12:
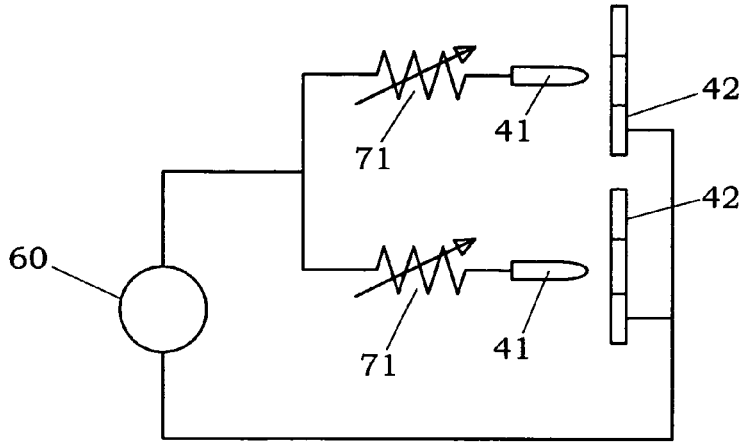
FIG. 12 is a schematic circuit diagram of the static atomizing device with a variable resistor.
Figure 13:
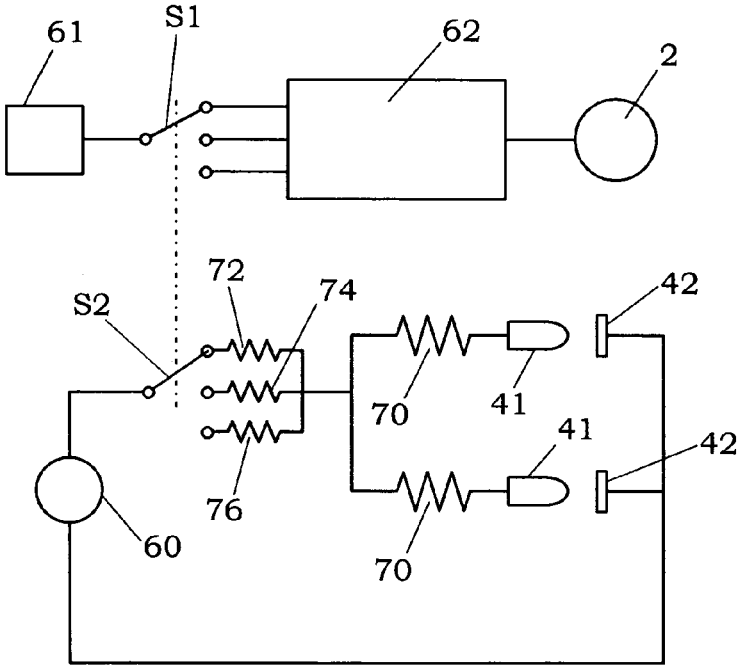
FIG. 13 is a schematic circuit diagram of a mist control unit.

As shown in FIG. 12, it is also preferred that at least one of the resistive elements 70 is provided by a variable resistor 71. Alternatively, the resistive element 70 may be formed such that a plurality of resistive elements having different resistance values can be switched. In this case, it becomes possible to control the mist generation amount according to the supply amount of the liquid to the atomizing electrode 41, or a change in temperature and humidity of the surrounding environment. In addition, as shown in FIG. 13, a switch S2 for switching between the resistive elements (72, 73, 74) having different resistance values may be interlocked with an operation of a switch S1 for changing the airflow amount provided by the fan 2. In this case, the static atomizing device 4 can be controlled such that as the airflow amount is increased, the mist generation amount becomes larger, and as the airflow amount is decreased, the mist generation amount becomes smaller. Thus, the components of FIG. 13 present a mist control unit having the capability of controlling the mist generation amount in response to the airflow amount. In FIG.13, the numeral 61 designates a power circuit of the hair dryer 1, and the numeral 62 designates a drive circuit for the fan 2.

Figure 14:
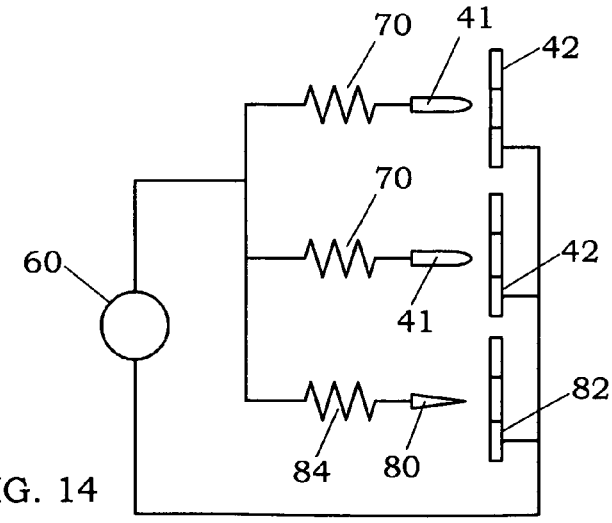
FIG. 14 is a schematic circuit diagram of the static atomizing device and a minus-ion generator.

In addition, the hair dryer 1 of the present invention may have a negative-ion generator provided with a needle-like electrode 80 connected to the voltage applying unit 60 and a counter electrode 82. For example, as shown in FIG. 14, when the needle-like electrode 80 of the negative-ion generator and the atomizing electrodes 41 are connected in parallel to the voltage applying unit 60, it is preferred that a resistive element 84 connected between the needle-like electrode 80 and the voltage applying unit 60 has a greater resistance value than the resistive elements 70 connected between the voltage applying unit 60 and the atomizing electrodes 41. Thereby, it is possible to stabilize the discharge states between the needle-like electrode 80 and the counter electrode 82 and between the atomizing electrodes 41 and the counter electrodes 42, and therefore efficiently generate both of the electrostatically charged microparticle mist and the negative ions.

What is claimed is:

1. A hair dryer comprising:

a housing formed in a substantially hollow structure, which has an air inlet, air outlet, and an airflow channel extending therebetween;

a fan configured to suck outside air into said housing through said air inlet to provide an air flow through said air outlet; and a static atomizing device configured to electrostatically atomize a liquid to generate an electrostatically charged microparticle mist of said liquid, wherein said static atomizing device comprises at least one pair of an atomizing electrode and a counter electrode, a tank configured to store said liquid therein, a liquid transport member configured to transport said liquid from said tank to said atomizing electrode prior to introduction of the liquid to the air flow, and a voltage applying unit configured to apply a voltage between said atomizing electrode and said counter electrode to generate the electrostatically charged microparticle mist, wherein said tank is detachably mounted in a tank chamber, which is formed in said housing such that said tank chamber is separated from said airflow channel by a partition wall, and wherein said housing comprises a tank cover pivotally supported at its one end on said housing to open and close said tank chamber, and said tank cover has a projection on its inside surface, which is configured to press said tank against the partition wall when said tank chamber is closed.

2. A hair dryer comprising:

a housing formed in a substantially hollow structure, which has an air inlet, air outlet, and an airflow channel extending therebetween;

a fan configured to suck outside air into said housing through said air inlet to provide an air flow through said air outlet; and a static atomizing device configured to electrostatically atomize a liquid to generate an electrostatically charged microparticle mist of said liquid, wherein said static atomizing device comprises at least one pair of an atomizing electrode and a counter electrode, a tank configured to store said liquid therein, a liquid transport member configured to transport said liquid from said tank to said atomizing electrode prior to introduction of the liquid to the air flow, and a voltage applying unit configured to apply a voltage between said atomizing electrode and said counter electrode to generate the electrostatically charged microparticle mist, wherein said liquid transport member is made of a flexible material, and connected at its one end to said tank and at its opposite end to said atomizing electrode, thereby transporting the liquid from said tank to said static atomizing electrode according to capillary phenomenon, and wherein said tank has a liquid outlet, through which the one end of said liquid transport member is projected in said tank in a substantially vertical direction, and wherein the one end of said liquid transport member is inserted in a protection tube, and spaced downward from a top end of said protection tube by a vertical distance of not larger than 0.5 mm.

3. A hair dryer comprising:

a housing formed in a substantially hollow structure, which has an air inlet, air outlet, and an airflow channel extending therebetween;

a fan configured to suck outside air into said housing through said air inlet to provide an air flow through said air outlet; and a static atomizing device configured to electrostatically atomize a liquid to generate an electrostatically charged microparticle mist of said liquid, wherein said static atomizing device comprises at least one pair of an atomizing electrode and a counter electrode, a tank configured to store said liquid therein, a liquid transport member configured to transport said liquid from said tank to said atomizing electrode prior to introduction of the liquid to the air flow, and a voltage applying unit configured to apply a voltage between said atomizing electrode and said counter electrode to generate the electrostatically charged microparticle mist, said hair dryer further comprising at least one of a cation exchanger and an anion exchanger disposed in said tank.

4. A hair dryer comprising:

a housing formed in a substantially hollow structure, which has an air inlet, air outlet, and an airflow channel extending therebetween;

a fan configured to suck outside air into said housing through said air inlet to provide an air flow through said air outlet; and a static atomizing device configured to electrostatically atomize a liquid to generate an electrostatically charged microparticle mist of said liquid, wherein said static atomizing device comprises at least one pair of an atomizing electrode and a counter electrode, a tank configured to store said liquid therein, a liquid transport member configured to transport said liquid from said tank to said atomizing electrode prior to introduction of the liquid to the air flow, and a voltage applying unit configured to apply a voltage between said atomizing electrode and said counter electrode to generate the electrostatically charged microparticle mist, and wherein said tank has an air intake, which is covered by a membrane member having permeability to air and non-permeability to said liquid, and a distance between said membrane member attached to said air intake and an upper inner surface of said tank is not larger than 1 mm.

5. A hair dryer comprising:

a housing formed in a substantially hollow structure, which has an air inlet, air outlet, and an airflow channel extending therebetween;

a fan configured to suck outside air into said housing through said air inlet to provide an air flow through said air outlet; and a static atomizing device configured to electrostatically atomize a liquid to generate an electrostatically charged microparticle mist of said liquid, wherein said static atomizing device comprises at least one pair of an atomizing electrode and a counter electrode, a tank configured to store said liquid therein, a liquid transport member configured to transport said liquid from said tank to said atomizing electrode prior to introduction of the liquid to the air flow, and a voltage applying unit configured to apply a voltage between said atomizing electrode and said counter electrode to generate the electrostatically charged microparticle mist, and wherein said atomizing electrode has an opening at its one end, which is configured to supply said liquid into a space between said atomizing electrode and said counter electrode, and wherein a size of said opening is determined such that a surface tension of said liquid at said opening is larger than a liquid head pressure applied to said opening by said liquid in said tank full-filled.

6. A hair dryer comprising:

a housing formed in a substantially hollow structure, which has an air inlet, air outlet, and an airflow channel extending therebetween;

a fan configured to suck outside air into said housing through said air inlet to provide an air flow through said air outlet; and a static atomizing device configured to electrostatically atomize a liquid to generate an electrostatically charged microparticle mist of said liquid, wherein said static atomizing device comprises at least one pair of an atomizing electrode and a counter electrode, a tank configured to store said liquid therein, a liquid transport member configured to transport said liquid from said tank to said atomizing electrode prior to introduction of the liquid to the air flow, and a voltage applying unit configured to apply a voltage between said atomizing electrode and said counter electrode to generate the electrostatically charged microparticle mist, and wherein said housing has a mist outlet formed in a different position from said air outlet, and a mist generation room configured to accommodate said atomizing electrode and said counter electrode therein, which is communicated to said mist outlet, said hair dryer further comprising a water absorbing material disposed in said mist generation room such that a distance between said atomizing electrode and said water absorbing material is larger than the distance between said atomizing electrode and said counter electrode.

7. A hair dryer comprising:

a housing formed in a substantially hollow structure, which has an air inlet, air outlet, and an airflow channel extending therebetween;

a fan configured to suck outside air into said housing through said air inlet to provide an air flow through said air outlet; and a static atomizing device configured to electrostatically atomize a liquid to generate an electrostatically charged microparticle mist of said liquid, wherein said static atomizing device comprises at least one pair of an atomizing electrode and a counter electrode, a tank configured to store said liquid therein, a liquid transport member configured to transport said liquid from said tank to said atomizing electrode prior to introduction of the liquid to the air flow, and a voltage applying unit configured to apply a voltage between said atomizing electrode and said counter electrode to generate the electrostatically charged microparticle mist, and wherein said static atomizing device comprises:

a plurality of atomizing electrodes connected in parallel to a voltage applying unit and counter electrodes, a single tank configured to store said liquid therein, liquid transport members each configured to transport said liquid from said single tank to one of said atomizing electrodes, and said voltage applying unit configured to apply a voltage between said atomizing electrodes and said counter electrodes to generate the electrostatically charged microparticle mist; and resistive elements connected between said voltage applying unit and said atomizing electrodes, said hair dryer further comprising a switch configured to adjust an amount of said airflow provided by said fan, and a mist control unit configured to change resistance values of said resistive elements to control a generation amount of the electrostatically charged microparticle mist in response to an operation of said switch.

8. A hair dryer comprising:

a housing formed in a substantially hollow structure, which has an air inlet, air outlet, and an airflow channel extending therebetween;

a fan configured to suck outside air into said housing through said air inlet to provide an air flow through said air outlet; and a static atomizing device configured to electrostatically atomize a liquid to generate an electrostatically charged microparticle mist of said liquid, wherein said static atomizing device comprises at least one pair of an atomizing electrode and a counter electrode, a tank configured to store said liquid therein, a liquid transport member configured to transport said liquid from said tank to said atomizing electrode prior to introduction of the liquid to the air flow, and a voltage applying unit configured to apply a voltage between said atomizing electrode and said counter electrode to generate the electrostatically charged microparticle mist, and wherein said static atomizing device comprises:

a plurality of atomizing electrodes connected in parallel to a voltage applying unit and counter electrodes, a single tank configured to store said liquid therein, liquid transport members each configured to transport said liquid from said single tank to one of said atomizing electrodes, and said voltage applying unit configured to apply a voltage between said atomizing electrodes and said counter electrodes to generate the electrostatically charged microparticle mist; and resistive elements connected between said voltage applying unit and said atomizing electrodes, said hair dryer further comprising a minus-ion generator composed of an needle-like electrode connected to said voltage applying unit, a counter electrode, and a resistive element connected between said needle-like electrode and said voltage applying unit, and wherein the resistive element of said minus-ion generator has a greater resistance value than the resistive elements of said static atomizing device.

* * * * *

UNITED STATES PATENT AND TRADEMARK OFFICE

CERTIFICATE OF CORRECTION

PATENT NO. : 7,676,952 B2
APPLICATION NO. : 11/338894
DATED : March 16, 2010
INVENTOR(S) : Takashi Nakagawa et al.

It is certified that error appears in the above-identified patent and that said Letters Patent is hereby corrected as shown below:

ON THE TITLE PAGE

Item (73) Assignee

~~Matsushita Electric Works, Ltd.~~ should read Panasonic Electric Works Co., Ltd.

Signed and Sealed this

Twenty-fifth Day of May, 2010

David J. Kappos

David J. Kappos
*Director of the United States Patent and Trademark Office*